United States Patent [19]

Poulos

[11] Patent Number: 4,664,075

[45] Date of Patent: May 12, 1987

[54] SYMMETRIC MANIFOLD

[75] Inventor: Stephen G. Poulos, Southfield, Mich.

[73] Assignee: General Motors Corporation, Detroit, Mich.

[21] Appl. No.: 792,870

[22] Filed: Oct. 30, 1985

[51] Int. Cl.[4] ..... F02M 35/00

[52] U.S. Cl. ..... 123/52 M; 123/52 MB

[58] Field of Search ..... 123/52 M, 52 MB, 52 MC

[56] References Cited

U.S. PATENT DOCUMENTS

| | | | |
|---|---|---|---|
| 1,745,020 | 1/1930 | Lawrence | 123/52 M |
| 1,883,781 | 10/1932 | Gosslav | 123/52 M |
| 3,024,774 | 3/1962 | Eby, Jr. | 123/52 M |
| 4,550,700 | 11/1985 | Yoshida et al. | 123/52 M |

FOREIGN PATENT DOCUMENTS

| | | | |
|---|---|---|---|
| 685860 | 7/1930 | France | 123/52 M |

OTHER PUBLICATIONS

"The Scientific Designs of Exhaust and Intake Systems", third edition by Philip H. Smith, C.Eng., M.I. Mech.E., M.S.A.E. in collaboration with John C. Morrison, B.Sc., Ph.D., C.Eng., M.I. Mech.E., published by Robert Bentley, Inc., 872 Massachusetts Avenue, Cambridge, Mass. 02139-1971, pp. 221-223, Dec. 1980.

*Primary Examiner*—Craig R. Feinberg

*Attorney, Agent, or Firm*—Robert J. Outland

[57] ABSTRACT

Symmetric intake manifold arrangements for engines with inline cylinders are disclosed having equal length runners and intake conditions. Exemplary arrangements for three-, four- and six-cylinder engines and dual port four-cylinder engines are illustrated.

7 Claims, 15 Drawing Figures

SYMMETRIC MANIFOLD

TECHNICAL FIELD

This invention relates to intake manifolds especially for inline internal combustion engines and the like and more particularly to intake manifolds having a high degree of symmetry in the distribution of inlet charges through their various branches.

BACKGROUND

For optimum operation, it is normally required that a multicylinder engine obtain equal performance from each of its cylinders. A common cause of unequal performance among the cylinders is asymmetry in the intake manifold causing unequal or dissimilar distribution of charges to the cylinders.

For example, engines in which fuel and recirculated exhaust gas (EGR) are mixed completely with air upstream of the manifold runners can suffer from maldistribution of the total charge, although fuel, air and EGR may be delivered in equal ratios to each cylinder. In other cases in which mixing persists as the charge flows through the manifold or when fuel or EGR are added downstream of the manifold, any asymmetry in the shape or arrangement of the runners can cause differences in charge composition among cylinders Even if all cylinders receive charges of the same composition and in the same amount, the characteristics of flow into the cylinders can differ because of differences in the path taken by the charge. These variations can result in differences in combustion rate between the cylinders. Finally, if the intake runners in a tuned intake system differ in lengths, then different cylinders will have different volumetric charging efficiencies as a function of engine speed.

Modern tuned intake manifolds for inline engines commonly consist of parallel runners connecting the intake ports of each cylinder to a single plenum. Thus, the plenum can be as long as the engine. Because the plenum volume is limited by packaging and weight constraints and by the requirements of intake system tuning, the plenum shape approaches that of a long cylinder or other oblong body. With air, and possibly EGR and/or fuel, entering at one point in the plenum, the potential for maldistribution along the length of the plenum is high.

If the manifold does not distribute the components of the charge adequately, then corrective dams or flow deflectors must be added experimentally until the design is satisfactory. Alternatively, the runners can be made to enter the plenum close together for a more compact plenum shape. However, unless the runners are symmetrically disposed and thorough mixing of air with fuel and EGR in the plenum can be guaranteed, maldistribution may still occur. In addition, the runners may now have different lengths and curvatures, introducing new sources for cylinder-to-cylinder charging differences.

SUMMARY OF THE INVENTION

The present invention provides a family of intake manifold configurations having the potential to eliminate many sources of charge maldistribution by virtue of intrinsically symmetric design features. This manifold concept allows the symmetric transfer of cylinder intake charges from a single point plenum entrance to various cylinder inlet ports arranged in a straight line along an engine frame or cylinder head. It does this by employing runners of identical lengths and shapes and providing an axisymmetric plenum for flow distribution to the cylinder head.

The arrangement of the manifold is such that the charges for the corresponding intake ports of each cylinder not only exit the plenum at points of radial symmetry, but they do so through runners arranged in the firing order of the engine. As a result, each charge experiences exactly the same pressure pulsations in the plenum and the symmetric runners as its neighbors. Thus, the manifold is symmetric by design, rather than being an asymmetrical design which must be corrected empirically to achieve flow symmetry.

These and other features and advantages of the invention will be more clearly understood from the following description of the structure of and theoretical basis for certain embodiments of the invention taken together with the accompanying drawings.

BRIEF DRAWING DESCRIPTION

Figure 6:
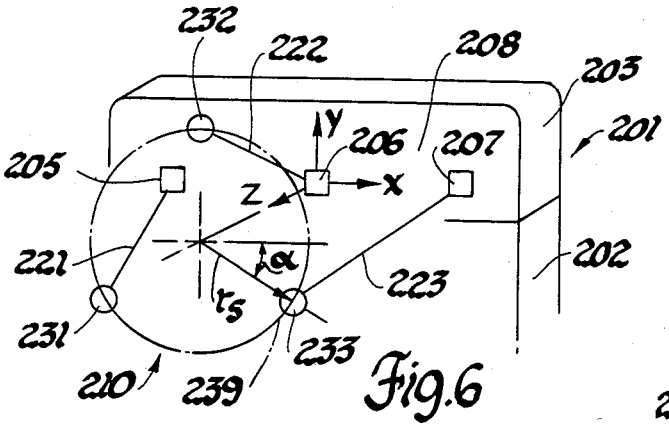
FIG. 6 is a schematic perspective view illustrating the application of a symmetric manifold according to the invention to a three-cylinder inline single port engine.
Figure 7:
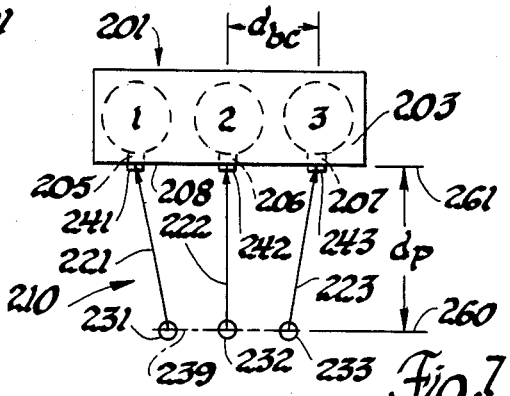
Figure 8:
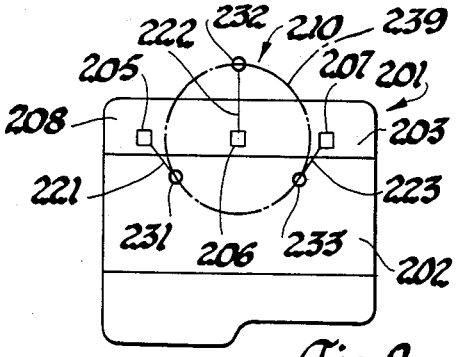
Figure 9:
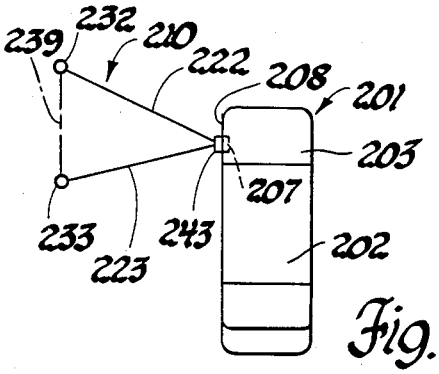
Figure 10:
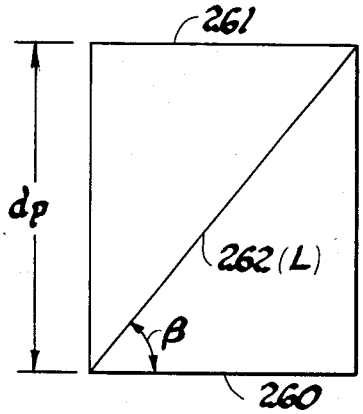
Figure 11:
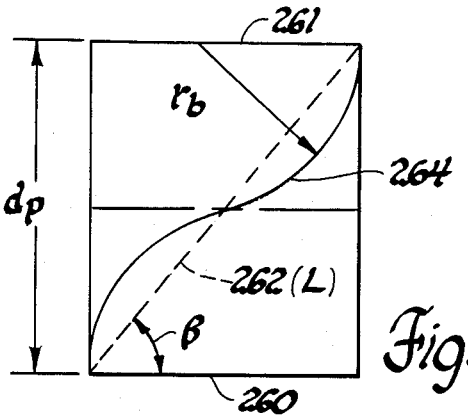
Figure 12:
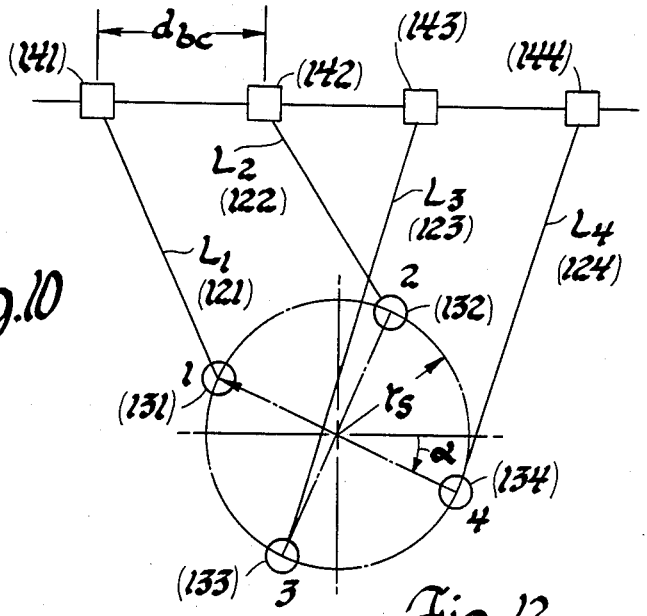
Figure 13:
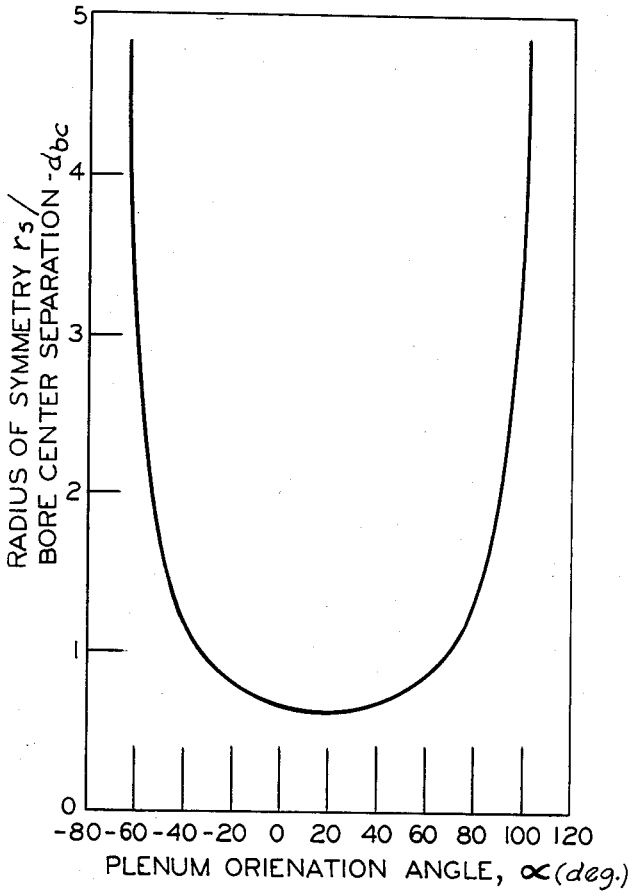
Figure 14:
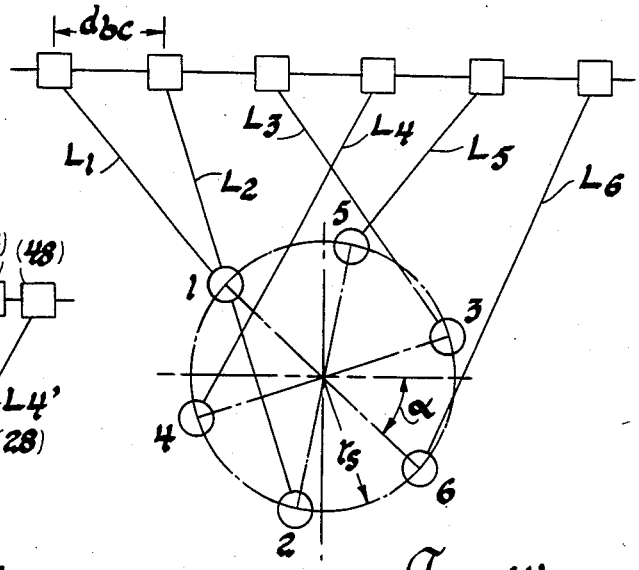
Figure 15:
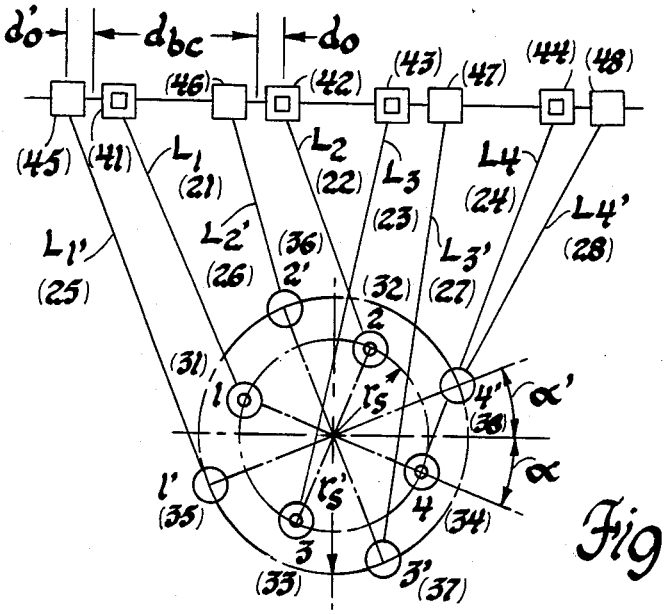

FIGS. 7, 8, and 9 are, respectively, top side and end views schematically illustrating the embodiment of FIG. 6;

FIGS. 10 and 11 are graphical illustrations schematically showing development of the manifold runners;

FIG. 12 is a schematic view illustrating characteristics of a symmetric manifold for a four-cylinder engine with evenly spaced single inlet ports;

FIG. 13 is a graphical illustration of Radius of Symmetry relationships for a four-cylinder engine of the type shown in FIG. 12;

FIG. 14 is a view similar to FIG. 12 but illustrating characteristics of a manifold for a six-cylinder inline engine; and FIG. 15 is a view similar to FIGS. 12 and 14 but illustrating characteristics of a manifold for a dual port inline four-cylinder engine.

DETAILED DESCRIPTION

Figure 1:
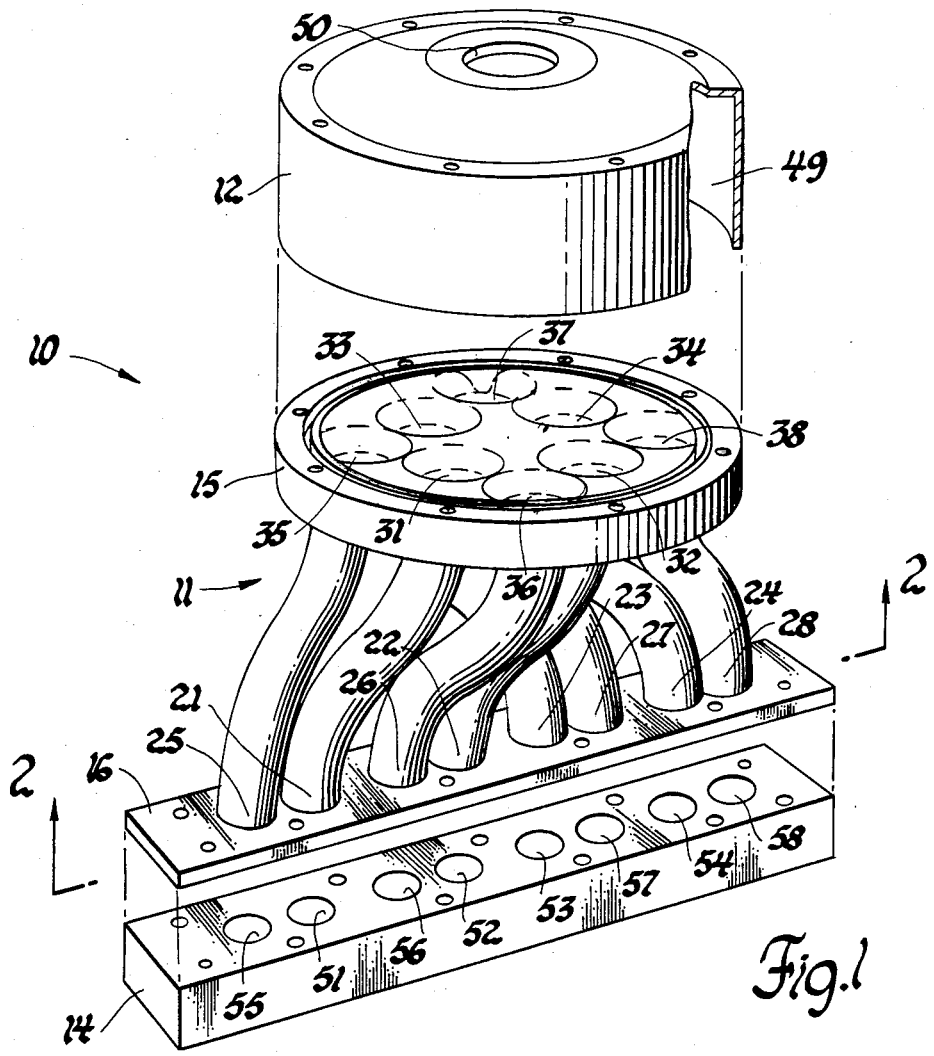
FIG. 1 is an exploded pictorial view of a manifold formed in accordance with the invention for a four-cylinder dual intake port inline engine.

Referring now to the drawings in detail, FIG. 1 illustrates in exploded form, a manifold assembly generally indicated by numeral 10 and formed in accordance with the invention for use with a four-cylinder inline internal combustion engine having dual cylinder intake ports for each cylinder. Assembly 10 includes three major elements: a runner and header body 11, a plenum cover 12 and an optional spacer 14. The body 11, shown also in FIG. 2, includes a disc-like inlet header 15, a plate-like outlet header 16 and eight curved tubular passage-defining runners indicated by numerals 21–28. As is subsequently more fully explained, the runners 21–28 are all of equal length and configuration and respectively interconnect a plurality of inlet openings 31–38 in the inlet header, arranged on concentric inner and outer circles 39, 40, respectively, with an equal number of linearly aligned outlet openings 41–48 in the outlet header.

In assembly, the plenum cover 12 is attached to the inlet header to define a plenum chamber 49 communicating with the inlet openings 31–38 and having a single inlet 50 extending through the central portion of the plenum cover 12. The inlet 50 thus lies on an axis through the center of the concentric circles 39, 40 and is equidistant from the openings 31–34 on the inner circle 39 as well as from the openings 35–38 on the outer circle 40.

The spacer 14 is attached, in assembly, to the outlet header 16 and includes a plurality of through passages 51–58 which connect with the outlet openings 41–48 and provide extensions of the manifold passages formed within the runners 21–28. The spacer 14 is also adapted to be connected with the cylinder head of the associated engine, not shown, with the passages 51–58 communicating with associated inlet ports of the engine.

If desired, the spacer could be dispensed with and the outlet header 16 of the body 11 could be connected directly with the engine cylinder head for communication with the engine intake ports. Alternatively, a suitable spacer section having straight or uniformly curved passages could be incorporated as part of the body 11.

Figure 2:
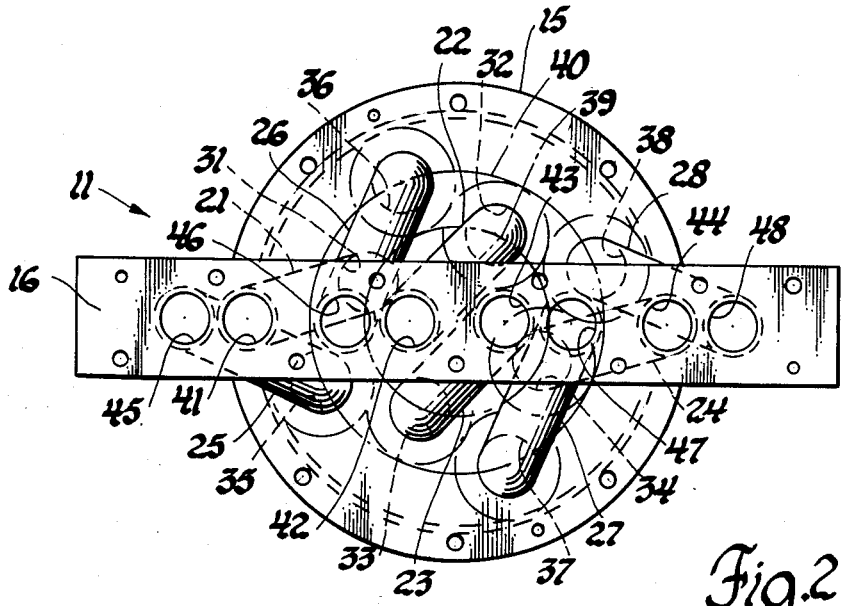
FIG. 2 is a view from the gas outlet side of the runner and header body of the manifold as seen from the plane indicated by the line 2—2 of FIG. 1.
Figure 3:
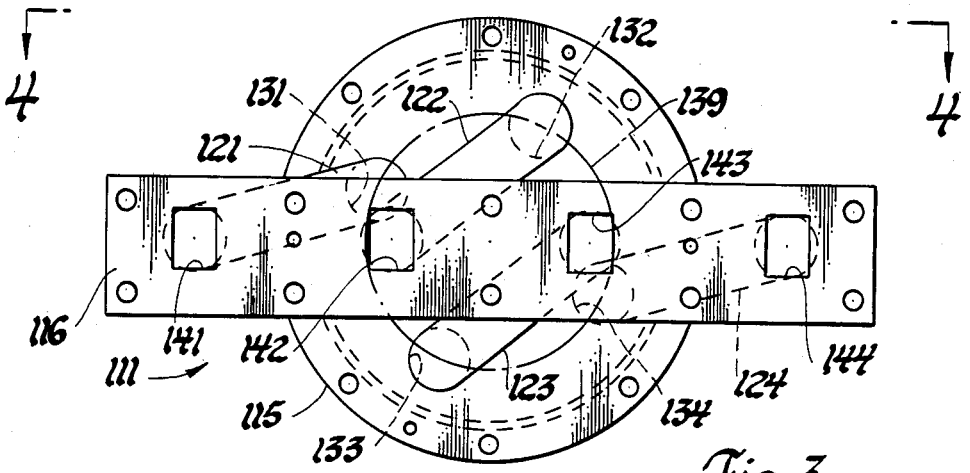
FIG. 3 is a side view similar to FIG. 2 but showing an alternative embodiment of manifold body configuration for a four-cylinder single intake port inline engine.
Figure 4:
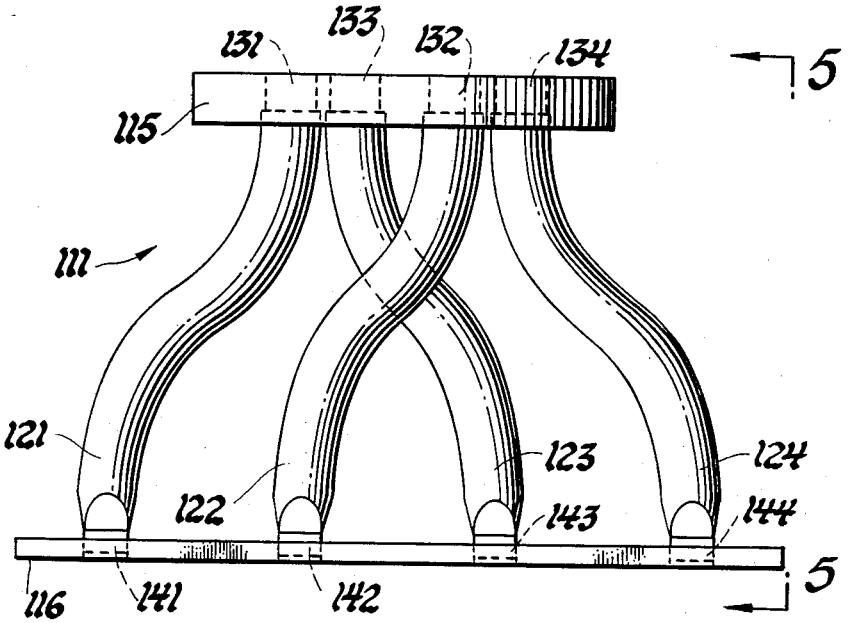
FIG. 4 is a top view of the manifold body member of FIG. 3 from the plane indicated by the line 4—4.
Figure 5:
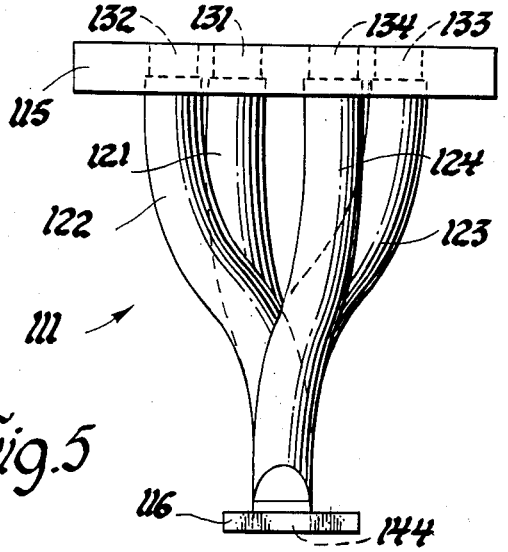
FIG. 5 is an end view of the manifold body member of FIG. 3 and 4 from the plane indicated by the line 5—5 of FIG. 4.

FIGS. 3–5 show an alternative embodiment similar in arrangement to the body 11 of FIGS. 1 and 2, except that it is designed for use with a four-cylinder inline engine having a single inlet port for each cylinder. Corresponding 100 series numerals are utilized to identify similar elements to the first described embodiment.

Thus, the body 111 of FIGS. 3–5 includes an inlet header 115, an outlet header 116 and four runners 121–124 communicating inlet openings 131–134 in the inlet header 115 with outlet openings 141–144 in the outlet header 116. A suitable plenum cover, not shown, is provided for connection with the inlet header 115 of the body 111 to provide a complete manifold assembly. If desired, a spacer, not shown, could also be provided.

As in the first described embodiment, the inlet openings 131–134 are equally spaced on a common circle 139, the outlet openings 141–144 are aligned and the curved runners 121–124 are of identical length and shape.

Accommodating Sources of Asymmetry

For a symmetric manifold according to the invention to be fully effective, the flows entering the plenum should be as axisymmetric as possible. If the plenum flows only air and is large enough to reduce flow velocities to the point where the pressure at the entrance to each runner is about the same, then minor asymmetries in the flow entering the plenum should not affect distribution at the runners. In such a case, it may be possible to locate the plenum inlet off center or at the side of the plenum, as long as a direct flow path to adjacent runners is not created.

However, if a partially closed throttle blade or other non-axisymmetric obstruction lies directly upstream of the plenum, the inlet flow could be directed in a manner that causes preferential feeding of some of the runners. In a case in which fuel or EGR are partially mixed in the plenum, a strong directed flow could cause asymmetric mixing, leading to variations in charge composition from runner to runner. Thus, to take full advantage of the symmetric manifold construction of the invention, the plenum should be as isolated as possible from any sources of strong directed flow, and the plenum volume and shape should be such as to maintain the same pressure immediately upstream of each runner.

The one asymmetry that can never be removed fully from the described symmetric manifold arrangements is the fact that each runner approaches the cylinder head from a different direction. However, unless the runners are severely curved, any minor asymmetry introduced by this source should have little or no effect on the flow direction by the time it reaches the intake ports. In practice, some straight length of runner is usually needed between the manifold configuration and the cylinder head to accommodate a mounting flange and, sometimes, fuel injectors. This straight or parallel section further helps remove asymmetries due to the non-parallel approach of the runners to the mounting header.

Packaging Constraints

As may be noted, for example, in FIG. 4, the intake runners of the symmetric manifold of the invention generally follow mildly curved paths from the plenum to the cylinder head. While the relative straightness of the runners helps minimize flow losses, it also introduces a potential limitation on the use of very long runners in practical vehicles due to packaging constraints. In systems where the tuning frequencies are such that relatively short runners are usable, this should not be a problem.

In other cases, however, the concepts of the manifold design may be carried out by revising the location of the plenum to occupy, for example, the area between or surrounding the runner tubes themselves, located between the inlet header 115 and the outlet header 116. Communication of a plenum so located with the runners 121–124 can be accommodated by a domed cap communicating with the outer side of the header 115 either around its periphery or through an opening in its center, to thereby connect axisymmetrically with the circularly spaced inlet openings 131–134.

Also, if desired, a side entry into the plenum might be utilized where the plenum is at a substantial distance from the connection with the runners so that flow symmetry into the runners is not substantially disturbed.

Manufacturability

Manufacturability of the symmetric manifold constructions of the present invention should not be drastically different from most other intake manifolds which are either cast in one piece or fabricated. Although either option is available for symmetric manifolds, the shape of the manifold of the present invention would require several complex cores in order to produce a casting. Fabrication on the other hand could take advantage of the fact that the runners are interchangeable to simplify the tooling and allow a thin wall and lightweight construction.

Design Concepts

FIGS. 6–11 illustrate some of the basic concepts of symmetric manifolds according to the invention and their application to an inline three-cylinder engine with one port per cylinder. Corresponding 200 series numerals are utilized to identify elements similar to those of the first described embodiment.

In FIGS. 6–9, numeral 201 generally indicates an engine having a cylinder block 202 including three cylinders numbered 1, 2 and 3 which are closed by a cylinder head 203. The cylinder head includes three ports which have inlets 205, 206, 207 opening through a side wall 208 of the cylinder head 203.

Attached to the cylinder head 203 is a manifold assembly generally indicated by numeral 210 and only portions of which are schematically illustrated. Manifold 210 includes three runners 221–223 which are schematically illustrated by straight lines but are actually curved as will be subsequently made clear. Runners 221–223 extend from manifold inlet openings 231–233, which define the exit from the plenum, not shown, to the port inlets 205–207 that connect with the associated manifold outlet openings 241–243. Various letter symbols, to be subsequently discussed, illustrate the geometric relationships of the manifold elements.

The runners leave the plenum by the manifold inlet openings 231–233 which are disposed on a common circle 239 having a radius $r_s$. The openings 231–233 are spaced radially 120° apart and are arranged in the firing order of a three-cylinder engine: 1-3-2 for counterclockwise rotation or 1-2-3 for clockwise rotation. The cylinders and their connected port inlets 205–207 are spaced at equal intervals, or separation distances, $d_{bc}$ the port inlets are longitudinally aligned. $d_p$ represents the separation distance between the plane 260 of the runner inlet openings 231–233 at the plenum exit and plane 261 of the cylinder head port inlets 205–207. x, y and z indicate horizontal vertical and lateral directions in the three-dimensional view and $\alpha$ indicates a reference angle to be subsequently discussed.

In FIG. 10, the diagonal line 262 is a true view of a straight line connecting any of the runner inlet openings 231–233 at the plenum exit plane 260 with its corresponding cylinder intake port 205–207 in their common plane 261. The line 262 forms an angle $\beta$ with the planes 260 and 261. In FIG. 11 the curved line 264 is a true view of a curved runner formed by replacing the straight line 262 with two tangent arcs of radius $r_b$ having centers in the planes 260, 261 so as to intersect these planes at right angles.

Given a known separation distance $d_{bc}$ between equally spaced ports, a value for the radius $r_s$ can be found such that the straight distance $L_1$ (262) from the port of cylinder No. 1 to its corresponding plenum exit (runner inlet opening) is equal to the straight distance $L_2$ from the port of cylinder No. 2 to its plenum exit. By symmetry, the corresponding straight distance $L_3$ for cylinder No. 3 must also be the same.

The radius of symmetry $r_s$ is independent of the separation $d_p$ between the plane 261 of the intake port inlets and the plan 260 of the plenum outlets. This is because the vector component of runner length contributed by $d_p$ is the same for all runners. In general, $r_s$ depends on the separation $d_{bc}$ between the ports and on the angle $\alpha$ that orients the runners at the plenum. If the intake ports are spaced evenly, $r_s$ is directly proportional to the separation between the ports. If the ports are spaced unevenly, $r_s$ depends also on the distance by which the ports are offset relative to the positions they would occupy if they were spaced evenly. The exact dependence of $r_s$ on the location of the ports and on $\alpha$ for engines with different numbers of cylinders will be discussed subsequently.

The symmetric manifold concept can be applied to engines with unevenly spaced ports if the ports are symmetrically located about a point bisecting the distance from the first to the last port. Port offset is accounted for in the calculation of straight line distances from the ports to their corresponding plenum exits. However, this offset is of secondary importance and, therefore, unless otherwise stated, the configurations presented here will assume that all intake ports are evenly spaced and that the distance between ports equals the distance between cylinder bore centers.

Symmetric manifolds can also be designed for some engines with two intake ports per cylinder. In the simplest case, the ports of each cylinder can be combined (siamesed) at the exit plane of the cylinder head so that a single port manifold design can be used. In the case of a dual port four-cylinder engine requiring separate port runners, it is possible to superimpose two manifold designs to obtain a symmetric manifold configuration with two sets of symmetric runners.

Three-Cylinder Engine Manifolds

Calculation of the geometric relationships for a three-cylinder engine manifold as shown in FIGS. 6–11 is as follows. Since the runners exit the plenum in the firing order of the engine and 120° apart, the angle $\alpha$ that fixes the orientation of the runners to the plenum must be 30°, as shown. To find the radius of symmetry $r_s$, the straight distance $L_1$ from the port of cylinder No. 1 to its plenum exit is equated to the corresponding distance $L_2$ for cylinder No. 2. These distances are:

$$L_1 = \sqrt{(d_{bc} - r_s \cos 30°)^2 + (r_s \sin 30°)^2 + d_p^2} \quad (1)$$

for cylinder 1, and, for cylinder 2:

$$L_2 = \sqrt{r_s^2 + d_p^2} \quad (2)$$

Requiring $L_1$ to equal $L_2$ gives, $$r_s = 0.577\ d_{bc} \quad (3)$$

With the radius of symmetry $r_s$ established, the manifold configuration is determined and the angle $\beta$, radii $r_b$ and resulting true shapes of the individual runners are easily calculated.

Four-Cylinder Engine Manifolds

FIG. 12 shows a symmetric manifold for a four-cylinder engine having equally spaced ports with a conventional firing order of 1-3-4-2 counterclockwise or 1-2-4-3 clockwise. The runners must exit the plenum 90° apart in the engine firing order. The straight distances $L_{1\text{-}4}$ from each of the cylinder ports to its corresponding plenum exit are as follows:

$$L_1 = \sqrt{(3d_{bc}/2 - r_s \cos \alpha)^2 + (r_s \sin \alpha)^2 + d_p^2} \quad (4)$$

$$L_2 = \sqrt{(d_{bc}/2 + r_s \sin \alpha)^2 + (r_s \cos \alpha)^2 + d_p^2} \quad (5)$$

Equating $L_1$ to $L_2$ gives the radius of symmetry:

$$r_s = 2d_{bc}/(3 \cos \alpha + \sin \alpha) \quad (6)$$

By symmetry, the corresponding straight distances $L_3$, $L_4$ for cylinders 3 and 4 must then also equal $L_1$ and $L_2$.

FIG. 13 graphically indicates the functional dependence of the radius of symmetry $r_s$ (normalized by the port separation) on $\alpha$ for intake manifolds of four-cylinder engines with evenly spaced single intake ports. Note that equation (6) gives a positive radius $r_s$ only for values of $\alpha$ between $-71.6°$ and $108.4°$. The need to maintain a reasonably small plenum radius further restricts the values of $\alpha$ to be between $-65°$ and $90°$, since $r_s$ approaches infinity near the limits of $\alpha$. In practice, another limitation on $\alpha$ is introduced by the need to avoid interference of runners. Thus values of 22.5° or $-22.5°$ for $\alpha$ usually give good results while minimizing runner interference. For a given total runner length, choosing $\alpha$ to be 22.5° gives a larger radius of symmetry and a larger runner bend radius than choosing $\alpha$ to be $-22.5°$.

Six-Cylinder Engine Manifolds

With six-cylinder engines, two three-cylinder engine manifolds in parallel are most effective for tuning the intake systems at lower engine speeds. However, duplicate manifolds require duplicate intake systems upstream of the two plenums or a connecting passage to unite the plenums. If these approaches are not feasible for any reason, a single symmetric manifold joining all six cylinders is possible.

Such a manifold is shown schematically in FIG. 14 for an inline six-cylinder engine. In this case, the runners exit the plenum 60° apart and in the engine firing order 1-4-2-6-3-5 counterclockwise or 1-5-3-6-2-4 clockwise. The straight distances $L_1$–$L_3$ from the ports of cylinders 1-3 to their respective plenum exits are:

$$L_1 = \sqrt{(5d_{bc}/2 - r_s\cos\alpha)^2 + (r_s\sin\alpha)^2 + d_p^2} \quad (7)$$

$$L_2 = \sqrt{[3d_{bc}/2 - r_s\cos(120° - \alpha)]^2 + [r_s\sin(120° - \alpha)]^2 + d_p^2} \quad (8)$$

$$L_3 = \sqrt{[d_{bc}/2 + r_s\cos(60° - \alpha)]^2 + [r_s\sin(60° - \alpha)]^2 + d_p^2} \quad (9)$$

Equating $L_1$ to $L_2$ and $L_3$ gives:

$$\alpha = 41.7° \quad (10)$$

and $$r_s = 1.2815\ d_{bc} \quad (11)$$

Again, symmetry requires that $L_4$, $L_5$ and $L_6$ be the same as $L_1$, $L_2$ and $L_3$.

Dual Port Four-Cylinder Manifolds

A symmetric manifold for a four-cylinder engine having two ports per cylinder is shown in FIG. 15. The ports are divided into inner and outer sets having radii of symmetry $r_s$, $r_s'$ around a common plenum axes. To accommodate two ports at each cylinder, the ports must be offset from the positions they would have if they were evenly spaced. The port offsets, indicated by $d_o$ for the inner runners and $d_o'$ for the outer runners, must be included in the calculation of the radii of symmetry for the two sets of runners.

The radius of symmetry $r_s$ for the inner runners is found by equating the straight distance $L_1$ from the inner port of cylinder 1 to its plenum exit 1 with the straight distance $L_2$ from the inner port of cylinder 2 to its plenum exit 2. The distances $L_1$ and $L_2$ are, respectively:

$$L_1 = \sqrt{(3d_{bc}/2 - d_o - r_s\cos\alpha)^2 + (r_s\sin\alpha)^2 + d_p^2} \quad (12)$$

and, $$L_2 = \sqrt{(d_{bc}/2 - d_o + r_s\sin\alpha)^2 + (r_s\cos\alpha)^2 + d_p^2} \quad (13)$$

Equating $L_1$ to $L_2$ gives the radius of symmetry for the inner runners:

$$r_s = (d_{bc} - d_o)/(1.5\cos\alpha + 0.5\sin\alpha - d_o(\cos\alpha + \sin\alpha)/d_{bc}) \quad (14)$$

Similarly, for the outer runners:

$$L_1' = \sqrt{(3d_{bc}/2 + d_o' - r_s'\cos\alpha')^2 + (r_s'\sin\alpha')^2 + d_p^2} \quad (15)$$

and, $$L_2' = \sqrt{(d_{bc}/2 + d_o' - r_s'\sin\alpha')^2 + (r_s'\cos\alpha')^2 + d_p^2} \quad (16)$$

Equating these two lengths gives the radius of symmetry for the outer runners:

$$r_s' = (d_{bc} + d_o')/(1.5\cos\alpha' - 0.5\sin\alpha' + d_o'(\cos\alpha' - \sin\alpha')/d_{bc}) \quad (17)$$

As one might expect, Equations 12, 13 and 14 correspond exactly with Equations 15, 16 and 17, respectively, if appropriate sign conventions for $\alpha$ and $d_o$ are used.

While the invention has been disclosed by reference to certain specific embodiments chosen for purposes of illustration, it should be understood that numerous changes and variations could be made without departing from the scope of the inventive concepts described. Accordingly, it is intended that the invention not be limited to the described embodiments but that it have the full scope permitted by the language of the following claims.

The embodiments of the invention in which an exclusive property or privilege is claimed are defined as follows:

1. A high symmetry intake manifold for an internal combustion engine, said manifold comprising an inlet plenum with a flat floor extending along an inlet plane and outlet means defining an outlet plane, said planes being spaced on a common axis normal to both, a plurality of equal length runners connecting inlet openings in the floor and lying along the inlet plane with linearly equidistant outlet openings in outlet means and lying along the outlet plane, the inlet openings being spaced in the floor on a circle centered on the axis and the outlet openings being linearly aligned in the outlet means with the outlet axis intersecting the plane at the midpoint between outer most ones of the outlet openings.

2. A manifold as in claim 1 wherein said inlet openings are equally spaced about the circle and said outlet openings are equally spaced in the outlet means, said runners having ends normal to the inlet and outlet planes where the runners intersect the planes to provide a high degree of symmetry for gas entry to and egress from the runners.

3. A manifold as in claim 2 wherein the runners each define opposite curves of equal angular extent lying in a single plane.

4. A symmetric intake manifold for a multicylinder inline engine having two intake ports per cylinder, said manifold comprising outlet means defining an outlet plane with a plurality of outlet openings consisting of two groups, each group including one outlet opening for each cylinder and the openings of each group being aligned, lying along the outlet plane and connectable with respective ones of said intake ports, an inlet plenum having a flat floor parallel with and spaced from said outlet plane and having a plurality of inlet openings through said floor equal in number with said outlet openings, and a plurality of runners, each connecting one of said inlet openings with an associated one of said outlet openings, said inlet openings consisting of two groups, each group including one inlet opening for each cylinder and the openings of each group being equally spaced about a circle on said floor centered on an axis normal to and intersecting the outlet plane at a midpoint between outer most ones of said outlet openings associated with their respective inlet opening group, locations of said inlet openings being at equal linear distances from the associated outlet openings, and said runners being of equal length and having ends extending normal to the outlet plane and the plenum floor at their connections with the outlet and inlet openings respectively.

5. A manifold as in claim 4 for an engine wherein said intake port openings are all aligned in and lying along said outlet plane and said port opening groups include inwardly and outwardly spaced ports, said groups having a common midpoint, said inlet openings being located on concentric circles on said plenum floor.

6. A high symmetry intake manifold for an internal combustion engine, said manifold comprising outlet means defining a plurality of outlet openings spacedly aligned in and lying along a common outlet plane, an inlet plenum having a circular floor extending along a plane spaced from and parallel with said outlet plane and centered on an axis normal to and intersecting said outlet plane at the midpoint between outer most ones of said outlet openings, said plenum having a plurality of inlet openings through said floor, and a plurality of runners, each connecting one of said inlet openings with one of said outlet openings, said inlet openings being disposed in circular fashion in said floor at equal distances from said axis and spaced from one another at equal intervals such that the connected inlet and outlet openings are spaced at equal linear distances from one another, said connecting runners also being of equal lengths.

7. A manifold as in claim 6 wherein said connecting runners define opposite curves of equal angular extent lying in a single plane, ends of each runner lying along parallel axes spaced at equal distances and normal to said plenum floor and said outlet plane, wherein essentially symmetrical conditions of gas entry to and exit from said manifold runners are provided.

* * * * *